US006686021B1

(12) United States Patent
Case

(10) Patent No.: US 6,686,021 B1
(45) Date of Patent: Feb. 3, 2004

(54) BEADING PATTERN SURFACE AND METHOD FOR CREATING BEADWORK

(76) Inventor: Frances Janney Case, 7033 E. Paseo San Andres, Tucson, AZ (US) 85710-2205

( * ) Notice: Subject to any disclaimer, the term of this patent is extended or adjusted under 35 U.S.C. 154(b) by 53 days.

(21) Appl. No.: 09/583,628

(22) Filed: May 31, 2000

Related U.S. Application Data

(60) Provisional application No. 60/138,219, filed on Jun. 9, 1999.

(51) Int. Cl.[7] ..... B32B 3/24; B32B 5/30

(52) U.S. Cl. ..... 428/131; 428/195.1; 428/207; 428/143; 29/433; 269/47; 63/37; 63/38

(58) Field of Search ..... 428/131, 195.1, 428/207, 143; 29/433; 63/37, 38; 269/47

(56) References Cited

U.S. PATENT DOCUMENTS 1,499,769 A * 7/1924 Godefroy ..... 245/1
1,508,818 A * 9/1924 Podia ..... 28/151
2,102,746 A * 12/1937 Reilly ..... 29/10
3,545,069 A * 12/1970 Krieger ..... 269/47
3,708,862 A * 1/1973 Powell, Jr. ..... 29/433
4,016,183 A * 4/1977 Wallach ..... 156/63
5,292,255 A * 3/1994 Goldwasser ..... 434/81
5,494,734 A * 2/1996 Widders ..... 428/11
5,562,451 A * 10/1996 Wilcox et al. ..... 434/81

* cited by examiner

*Primary Examiner*—William P. Watkins, III

(57) ABSTRACT

A beading pattern surface which contains spaces (60) formed by predetermined horizontal lines (40) and predetermined vertical lines (20), and an accompanying method for using the beading pattern surface. The spaces formed by the horizontal and vertical lines are no less than the nominal size of the beads to be used with the beading pattern in constructing the beadwork, and are generally larger in at least one orientation. The spaces of the beading pattern surface may be of different configurations, corresponding to the placement of beads in different beading stitches, and of different sizes, corresponding to the different sizes of beads used. The beading surface may be made of a variety of materials and may have a variety of properties useful for executing beadwork. The beading pattern surface may be used with the accompanying beading method as a means for following patterns, for producing consistent tension, and for improving output and quality of beadwork.

14 Claims, 2 Drawing Sheets

20 = vertical lines
40 = horizontal lines
60 = spaces

BEADING PATTERN SURFACE AND METHOD FOR CREATING BEADWORK

CROSS-REFERENCE TO RELATED APPLICATIONS

This application claims the benefit of U.S. Provisional Application No. 60/138,219 filed Jun. 9, 1999.

STATEMENT REGARDING FEDERALLY SPONSORED RESEARCH AND DEVELOPMENT

Not Applicable.

REFERENCE TO A MICROFICHE APPENDIX

Not Applicable.

BACKGROUND

1. Field of Invention

This invention relates to beadwork, specifically to beading pattern surfaces and a method of doing beadwork.

2. Background of the Invention

Because of the fine nature of many beadworks, the person constructing the beadwork (the beader) works on small detail from a close perspective. Consequently, a mistake is not often discovered until the beader has progressed many rows beyond the point at which the mistake was made. Therefore, devices and methods to minimize these mistakes are required.

Beaders oftentimes use pattern paper. The pattern paper typically consists of a series of rows and columns laid out in a grid of sorts to create a number of spaces indicating the position of beads depending on the particular beading stitch to be employed. Pattern paper may be purchased with or without a design already integrated into this bead grid.

Executing beadwork from beading patterns on available pattern paper has been difficult because the patterns are used separately from the beadwork being produced. The beader holds the beadwork being created while the pattern from which it is being created is on a table or stand. The beader must continuously look back and forth from the pattern to the project being beaded. It is time-consuming and also very easy for the beader to lose his or her place when even the smallest distraction occurs.

In addition to varying the location and color of the beads, the beader may construct a piece of work using varying stitches. Examples of stitches include loom, peyote, brick, comanche, square, and netting stitches. When using certain stitches, the beader is required to move from one row to an adjacent row. When moving from one row to an adjacent row in these stitches, the beader must use a "jump-up bead" or "jump-down bead" (the "jump bead"). The jump bead is a point in the beading work at which the risk of error is even greater. Moreover, certain patterns designate, or the beader may choose a location for, the jump bead to progress diagonally around/across the pattern as the beader works up/down the piece. Failure to mark off each row after its completion causes beaders to lose their place, skip rows, and repeat rows, thus creating mistakes which diminish the quality of the finished piece or necessitates removing and redoing the incorrect rows. In a project comprising hundreds of rows it is almost inevitable that a beader will forget to mark off some of those rows.

In addition, in beadwork it is difficult to predict the size of a finished piece. An actual size pattern might have more than 16 beads per inch in each direction, depending on the size beads being used. Because of the small size of beads in such instances, beading patterns have traditionally been enlarged to make them easier to see and follow. In so doing however, the beader loses the sense of the true size of the finished work.

Another critical aspect of beading is creating and maintaining the proper tension in the beadwork. The tension of a beadwork is regulated by the number of beads per inch. Thus, if the beader uses more beads per inch, the finished beadwork will have a greater tension or "stiffness." When working with a non-flat form, it is difficult to know how many beads you should put around any given form, or conversely to know what size form to use for a pattern comprising a given number of beads, to create a desireable tension. These are critical decisions since the number of beads used to cover a given area directly affects the tension of the finished beadwork. If the tension is improperly gauged, the finished beadwork will be too stiff or will buckle, reducing the usefulness or attractiveness of the finished beadwork. Beaders have long complained about the difficulty in following patterns and in achieving a consistent and desireable tension.

More recently pattern papers have been developed which have spaces in the grid sized to correspond exactly to bead sizes and laid out to correspond exactly to specific bead stitches. These pattern papers are designed to be used in the traditional manner, i.e., separate from the beadwork being created. Before the introduction of the Tube Aloo device, described in more detail below, no one suggested that such pattern papers be used integrally with the beading form. These pattern papers are designed to show the size the finished piece will be. Due to the very small size of the spaces, patterns on these papers will be very difficult to see. These pattern papers do nothing to resolve the problems or difficulties encountered by the beader in following the pattern (pattern following) or creating or maintaining the proper tension in the work during the beading. Because the flat pattern paper does not allow for any open thread space to permit flexibility in the finished beadwork, or appropriately account for the difference in geometry between the flat pattern grid and the geometry of a grid that would exist in a non-flat beadwork (such as, for example, a tubular beadwork), discrepancies between the pattern grid and the beadwork will inevitably arise. Most times, the beadwork produced from employing these patterns is too tight.

Still more recently, in 1995, a tubular bead loom was developed which consists of a clear acrylic hollow tube, open at both ends. It is called a Tube Aloo and comes in two (2) sizes. The idea is to put a rolled beadwork pattern paper, of the type described above, or a rolled picture, inside the clear tube and bead around the outside of the tube. The concept of beading over the pattern was new, but there are several problems with this device. The beader is limited to working with only two sizes of the Tube Aloo, limiting the size of the finished work. Traditionally, beaders have used any available form such as cardboard centers from toilet and wrapping paper, pieces of PVC pipe, oatmeal boxes, or other forms from which the completed beadwork can be removed. The Tube Aloo also does not solve the problem of creating or maintaining the proper tension in the work. It fails to indicate to the beader how many beads to use around the Tube Aloo.

Although the Tube Aloo attempts to solve the difficulty of pattern following it does not do so. There is no beading pattern paper specifically designed for use with the Tube Aloo, nor is any beading pattern paper recommended for use with the Tube Aloo. The difference between the inside and outside circumferences of the Tube Aloo negates the value of being able to see the pattern beneath the beadwork being created. Moreover, given this difference, the bead spaces designated on presently available pattern papers do not line up with the actual placement of the beads in the beadwork. In addition, the bead spaces are not sized for use with this device in which the beading is done over the pattern. The size of the bead indicated in the patterned paper does not have the correct relationship to the size of the beads to be used in the work to maintain the proper tension. Thus, these discrepancies cause problems with controlling the tension of the beadwork.

The Tube Aloo also does not work well if the beader uses a picture instead of a bead pattern as a guide. Because: (a) no bead lines or spaces are designated in an ordinary picture, (b) most stitches do not allow for random placement of individual beads, and (c) the color in a picture may change at a point in the interior of a bead space, the beader must repeatedly make decisions concerning the choice of color for a bead at the point where the picture color changes. Incorrect choices do not become apparent until the entire project is complete. To further compound these difficulties, the beader must also decide how many beads to use around the form.

Flat beadwork has commonly been done with no form or base that is designed for that particular purpose. The relevant art does not suggest any techniques for doing flat beadwork that minimizes mistakes beyond the traditional methods that employ pattern paper and the published suggestions discussed below.

Many bead oriented books, including the *Beady Eyed* series, and *Those Bad Bad Beads*, do not deal at all with pattern following and tension problems. These books only describe how to do the stitches.

Some books, including *Beaded Amulet Purses* by Nicolette Stessin and *Creative Bead Weaving* by Carol Wilcox Wells, discuss both pattern following and tension maintenance employing traditional methods. They offer some general comments about bead count and tension, and ideas for pattern following, when the pattern is separate from the beadwork. These books state that the bead count will depend on the circumference of the form being used and suggest leaving a "few" bead spaces of empty thread so the finished work will not be too tight. This is a good general rule when the beader stays within fairly narrow size limits, which are not specified in any known books on beading. Thus, for example, for a tubular beadwork involving only 12 beads around, a three-bead space of empty thread is a much larger percentage of empty thread space than for a tubular beadwork with a total of, for example, 120 or 300 beads around. In the case of flat beadwork, these books, while stressing the importance of proper tension, fail to provide specific suggestions concerning the regulation of tension in the flat beadwork.

For pattern following, books in the field discuss the diagonal movement of the first bead in each new row on the pattern, or the jump bead. The pitfalls inherent in these steps of beading are acknowledged and suggestions are offered for dealing with them, and for keeping track of a beader's place in the pattern being used. The writers suggest marking off each row as it is completed with a writing instrument, a clear ruler or a magnet. However, if the beader forgets to mark off even one row, the beadwork will be flawed.

Thus, developments in beadwork pattern papers and beading methods offer suggestions and improvements, but fail to solve the problems of following patterns and achieving a desirable and consistent tension when creating beadwork.

SUMMARY

The present invention comprises a surface on which to put beadwork patterns for use on the exterior of a beading form. In particular, the present invention is a beading pattern surface comprising a grid in which the grid elements correspond to a single bead and the number of grid elements per inch is designed to create the proper tension in the finished beadwork. The present invention includes a grid pattern that is designed to allow enough open thread space to permit flexibility in the finished beadwork or to account for the different number of beads per inch in a finished work attributable to the geometric differences between the beading form on which the finished beadwork is made and the flat surface on which the pattern is printed. Moreover, the present invention is a device for use in beading comprising a beading pattern surface with the grid of the present invention in combination with a beading form on which the beading pattern surface is affixed.

The present invention comprises a method of producing a beadwork in which the beader produces the beadwork directly over the beading pattern surface described herein. The present invention further comprises a method of producing a beadwork by using a form on which the beading pattern surface is affixed to the external surface of such form. In an additional embodiment of the present invention, the foregoing method further comprises using a beading pattern surface comprising a grid pattern that is designed to allow enough open thread space to permit flexibility in the finished beadwork or to account for the different number of beads per inch in a finished work attributable to the geometric differences between the beading form on which the finished beadwork is made and the flat surface on which the pattern is printed.

DESCRIPTION OF THE PRESENT INVENTION

As can be seen from the foregoing discussion, there is a genuine need in the production of beadworks to address the many problems encountered therein. The present invention has as its objectives and advantages:

1. To provide a method for following beadwork patterns that is easier than the traditional methods.

2. To provide a method for following beadwork patterns that reduces the chance of human error.

3. To provide a method for achieving consistent and desirable tension in finished beadwork.

4. To provide a method for achieving consistent and superior quality in finished beadwork.

5. To provide a method for increasing the speed in which beadwork may be done.

6. To provide a pattern surface that is the means for implementing the foregoing methods.

Further objects and advantages are to provide a pattern surface which can be used for tracing, which can be cleaned and reused numerous times, which can be used for a number of different beading stitches, and which can be used for a number of different sizes of beads.

The beading pattern surface of the present invention enables the beader to create a beadwork directly over the desired pattern rather than requiring the beader to compare the pattern in the beadwork being created against a physically separate pattern. In addition, the beading pattern surface of the present invention automatically and concurrently regulates the tension maintained within the beadwork so that the finished beadwork is neither too stiff for its intended purpose nor too loose so that the structure of the beadwork is lost.

The construction of the beading pattern surface of the present invention depends upon the particular orientation of the individual beads within the pattern. This orientation represents different stitches used to create the beadwork. For example, FIG. 1 represents a beading pattern surface for use with two possible stitches to create the beadwork, one of which is known as "loom", and the other of which is known as "square." In this beading pattern surface (referred to herein as the "square pattern") as shown in FIG. 1, the beads are oriented such that the axis of the annulus of the beads is vertical, the edges of the individual beads create a pattern in which the vertical edges line up directly underneath each other to create a straight vertical line; likewise, the horizontal edges of the individual beads line up directly next to each other to create a straight horizontal line.

FIG. 2 represents a beading pattern surface for use with two possible stitches to create the beadwork, one of which is known as "brick" and the other of which is known as "comanche." In this beading pattern surface (referred to herein as the "brick patterns") as shown in FIG. 2, the beads are oriented such that the axis of the annulus of the beads is vertical, the horizontal edges of the individual beads line up directly next to each other to create a straight horizontal line but the vertical edges of the individual beads are offset from vertically adjacent beads so that the edges of the beads do not line up. The result is a pattern much like that of a brick wall.

FIG. 3 represents a beading pattern surface for use with the "peyote" stitch to create the beadwork. This beading pattern surface as shown in FIG. 3, referred to herein as the "peyote pattern," is similar to the brick or comanche beading pattern except that the peyote pattern is rotated ninety degrees. In the peyote pattern, this effect is created because the axis of the annulus of the beads is horizontal instead of vertical. The result is a beading pattern much like that of a brick wall set on end. Further variations and combinations of these patterns are shown in FIGS. 4, 5, 6, and 7.

In understanding how to construct the beading pattern surfaces of the present invention, it is helpful to refer to the "parallel orientation" as that orientation or direction or plane which is parallel to the axis of the annulus of the bead. Likewise, it is helpful to refer to the "perpendicular orientation" as that orientation or direction or plane which is perpendicular to the axis of the annulus of the bead.

It is also helpful to know that beads are available from various manufacturers in different sizes. The sizes of the beads are designated by numbers with the smallest sizes having the highest numbers and the largest sizes having the lowest numbers. For example, size 11 beads are commonly used in beadworks. The numbers used for size designations are intended to be standard across all manufacturers. Thus, size 11 beads from one manufacturer are intended to be interchangeable with size 11 beads from another manufacturer. However, the size of the beads varies within a particular size designation. Thus, the size designation refers to a nominal or ideal bead size and the beads within that size designation may vary somewhat from the nominal or ideal size. This variation is likely due to limitations in the manufacturing tolerances. References herein to the size of the beads means the nominal size of the beads. Those skilled in the art recognize that the size of many beads varies from their nominal size and oftentimes effort is made to cull from a sample of beads those which appear to vary too much from the norm.

In constructing the square pattern, the size of the individual bead spaces in the perpendicular orientation and in the parallel orientation are not the same size as the nominal sized beads used in constructing the beadwork. The individual bead spaces in both orientations are larger than the nominal sized beads used in the beadwork. In a preferred embodiment, the size of the individual bead spaces in the perpendicular orientation is no less than 105% of the nominal size of the bead used in making the beadwork and the size of the individual bead spaces in the parallel orientation is no less 108% of the nominal size of the beads used in making the beadwork. In the most preferred embodiment, the size of the individual bead spaces in the perpendicular orientation is between 105% and 110% of the nominal size of the beads used in making the beadwork, and the size of the individual bead spaces in the parallel orientation is between 110% and 114% of the nominal size of the beads used in making the beadwork.

In constructing the brick pattern or the peyote pattern, the size of the individual bead spaces in the perpendicular orientation may be the same as the nominal size of the beads used in constructing the beadwork but may also be slightly larger than the nominal size of the beads. In the parallel orientation, the size of the individual bead spaces are not the same size as the nominal sized beads used in constructing the beadwork. The individual bead spaces in the parallel orientation are larger than the nominal sized beads used in the beadwork. In a preferred embodiment, the size of the individual bead spaces in the perpendicular orientation is no more than 105% of the nominal size of the bead used in making the beadwork and the size of the individual bead spaces in the parallel orientation is no less than 105% of the nominal size of the beads used in making the beadwork. In a more preferred embodiment, the size of the individual bead spaces in the perpendicular orientation is between 100% and 105% of the nominal size of the beads, inclusive, and the size of the individual bead spaces in the parallel orientation is between 105% and 125% of the nominal size of the beads used in making the beadwork. In the most preferred embodiment, the size of the individual bead spaces in the perpendicular orientation is 100% of the nominal size of the beads used in making the beadwork, and the size of the individual bead spaces in the parallel orientation is between 105% and 112% of the nominal size of the beads used in making the beadwork.

The beading pattern surfaces shown in FIGS. 4 and 6 are variations of the brick pattern. These patterns will utilize only the brick or comanche stitches and do not employ any elements of the square, loom or peyote stitch. In these patterns, for every stitch made, instead of using only one bead, as in FIG. 2, two or more beads are used and treated as a single bead. In so doing, the beader obtains the desired variation in the beadwork pattern but utilizes the brick or comanche stitch. Thus, the teachings for constructing the brick pattern surfaces of the present invention apply equally to bead pattern surfaces of the type shown in FIGS. 4 and 6.

The beading pattern surfaces shown in FIGS. 5 and 7 are variations of the peyote pattern. These patterns will utilize only the peyote stitch and do not employ any elements of the square, loom, brick or comanche stitch. In these patterns, for every stitch made, instead of using only one bead, as in FIG. 3, two or more beads are used and treated as a single bead. In so doing, the beader obtains the desired variation in the beadwork pattern but utilizes the peyote stitch. Thus, the teachings for constructing the peyote pattern surfaces of the present invention apply equally to bead pattern surfaces of the type shown in FIGS. 5 and 7.

In some beadworks, more than one stitch may be used. Thus, the present invention may be employed by piecing together different configurations of the beading pattern surface, corresponding to the desired stitch, to from a single multi-stitch beading pattern surface.

The manner of using the beading pattern surface uses some traditional techniques and some new techniques. Following traditional techniques, before using the beading pattern surface of the present invention, the beader must select the project, the beading stitch to be used in constructing the beadwork, and the size of the bead to be used in the beadwork. The beading pattern is put on the beading pattern surface for the chosen stitch and bead size by integrating into it the particular picture, color scheme, or design. The beading pattern may be so integrated in ways well known in the art including by hand with a writing or coloring instrument, by copy machine, or by printer or computer.

The manner of using the beading surface once the pattern has been placed upon it is different from the traditional methods. Since the patterned beading surface may be flexible or rigid there are several ways to use it.

The beading pattern surface of the present invention may be made on a flexible medium and wrapped around/over a non-flat form and securely fixed to the form. The size of the form and the size of the contemplated beadwork pattern must match. Means of securing the surface to the form include tape, glue, and clips. The beader then beads directly over the beading pattern on the beading pattern surface using the pattern on the pattern surface as a guide for the placement and color of beads.

The beading pattern of the present invention may also be used on flat surfaces while retaining its objectives and advantages. The beading pattern surface of the present invention may be made on a flexible medium and fixed to a rigid, flat work surface or may be made directly on a flat, rigid medium. In either case, fasteners may be used to hold the beadwork in position as each row is completed, thus ensuring that the correct pattern shape and size will be maintained. As in the flexible embodiment, the beader then beads directly over the beading pattern on the beading pattern surface using the pattern on the pattern surface as a guide for the placement and color of beads.

In all uses of the beading pattern surface the space into which each bead is positioned is dictated by spaces (60) formed by horizontal lines (40) and vertical lines (20). Thus, the beader is guided by the location of the bead spaces on the beading pattern surface and by the color of the pattern integrated into the beading pattern surface.

Still further objects and advantages will become apparent from a consideration of the ensuing description and drawings.

DRAWING FIGURES

Figure 4:
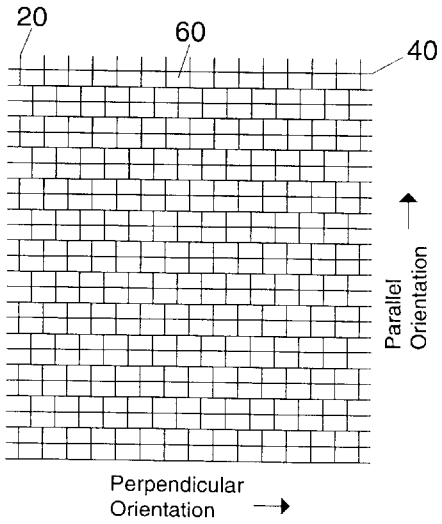
Figure 6:
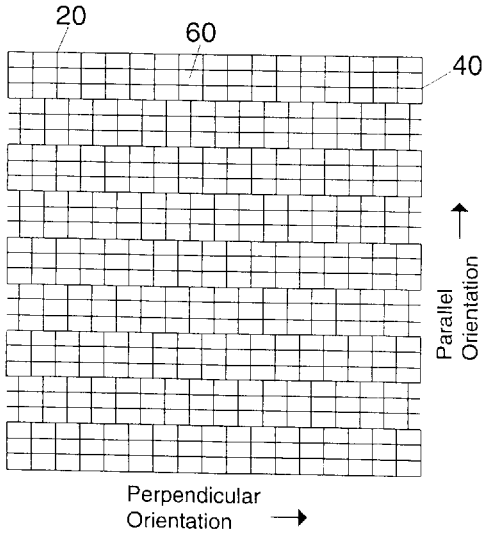

FIGS. 4 and 6 each shows a variation of a brick beading pattern surface with spaces in horizontal straight lines, with each set of plural horizontal lines of spaces being offset from adjacent sets of plural horizontal lines of spaces.

Figure 5:
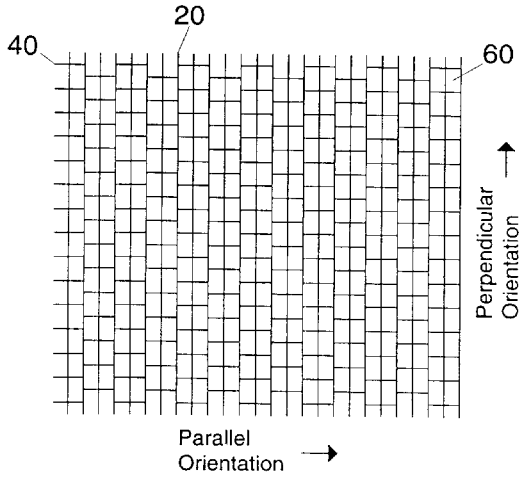
Figure 7:
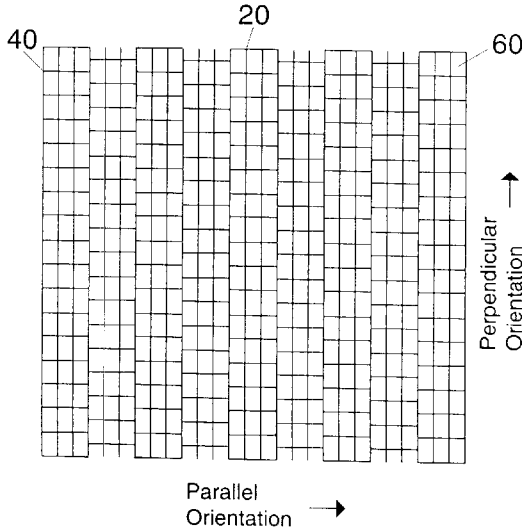

FIGS. 5 and 7 each shows a variation of a peyote beading pattern surface with spaces in vertical straight lines, with each set of plural vertical straight lines of spaces offset from adjacent sets of plural vertical straight lines of spaces.

REFERENCE NUMERALS IN DRAWINGS

20 vertical lines
40 horizontal lines
60 spaces formed by vertical and horizontal lines

DESCRIPTION—FIG. 1

An embodiment of the square beading pattern surface showing horizontal lines (40) and vertical lines (20) forming spaces (60) that are in vertical and horizontal straight lines.

Figure 1:
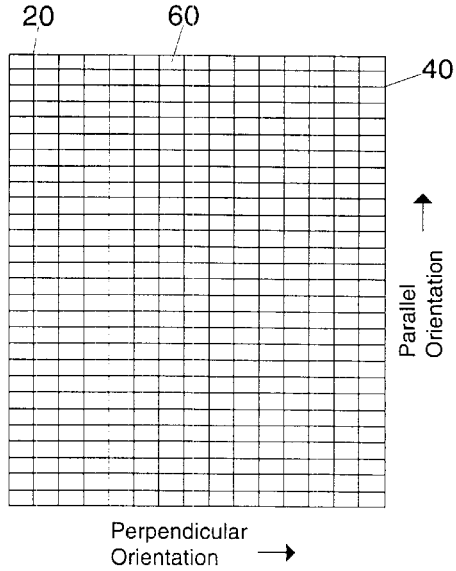
FIG. 1 shows a square beading pattern surface with spaces in horizontal straight lines and in vertical straight lines.
Figure 2:
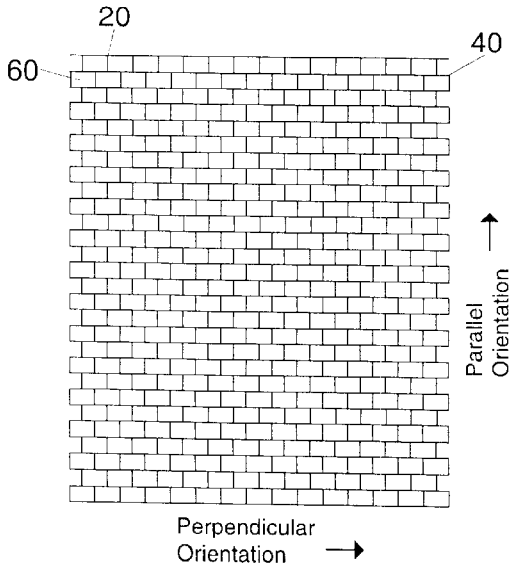
FIG. 2 shows a brick beading pattern surface with spaces in horizontal straight lines, with each horizontal straight line of spaces being offset from adjacent horizontal straight lines of spaces, as in a brick wall.

FIG. 2—Additional Embodiment

An embodiment of the brick beading pattern surface showing horizontal lines (40) in straight lines and vertical lines (20) forming spaces (60) that are offset from adjacent horizontal lines of spaces (60).

Figure 3:
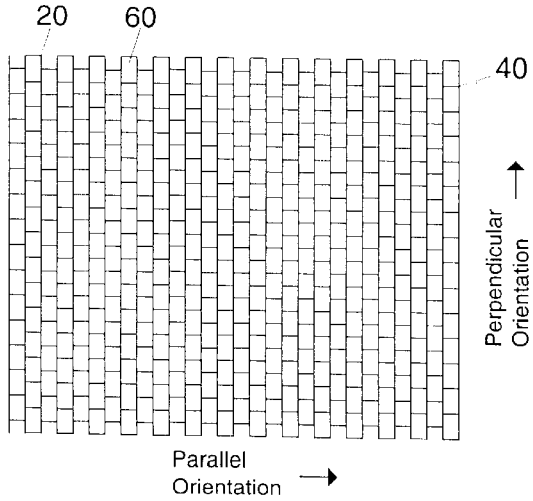
FIG. 3 shows a peyote beading pattern surface with spaces in vertical straight lines, with each vertical straight line of spaces being offset from adjacent vertical straight lines of spaces, as in a brick wall set on end.

FIG. 3—Additional Embodiment

An embodiment of the peyote beading pattern surface showing vertical lines (20) in straight lines and horizontal lines (40) forming spaces (60) that are offset from adjacent vertical lines of spaces (60).

FIGS. 4 & 6—Additional Embodiment

An embodiment of variations on the brick beading pattern surface showing straight horizontal lines (40) and vertical lines (20) forming sets of plural spaces (60) that are offset from adjacent sets of plural vertical lines of spaces (60).

FIGS. 5 & 7—Additional Embodiment

An embodiment of variations on the peyote beading pattern surface showing straight vertical lines (20) and horizontal lines (40) forming sets of plural spaces (60) that are offset from adjacent sets of plural horizontal lines of spaces (60).

Advantages

A number of advantages of the beading pattern surfaces of the present invention are evident.

(a) It may be made of a variety of materials as long as the beading pattern surface will accept marks, including those made by a writing instrument, a copy machine, a computer printer, or a printer.

(b) It may be rigid enough to serve as a work surface with the pattern directly on it.

(c) It may be flexible enough to be wrapped over/around a non-flat work surface, such as a tubular surface, or laid upon a flat surface.

(d) It may be transparent so that patterns may be traced on to it.

(e) It regulates the flexibility of the finished beadwork through the predetermined size of the spaces which provide the proper spacing of the beads to ensure a predetermined and consistent tension.

(f) It may be constructed for use in any size of bead or for any type of stitch.

(g) It allows the beader to easily follow the beading pattern, especially those that have traditionally been difficult to follow, because the beadwork is constructed directly over the pattern surfaces of the present invention.

(h) It considerably shortens the time required to execute a piece of beadwork because the beader no longer has to look back and forth from the pattern to the beadwork, or has to keep track of her/his place in the beadwork.

(i) It reduces the number of mistakes made by beaders because some elements that lead to human error have been lessened or eliminated.

(j) It may be used for constructing any size or configuration of the beadwork.

Conclusion, Ramifications, and Scope

Accordingly, the reader will see that the beading pattern surface of the present invention, and that the methods of the present invention, can be used as a simple and efficient method of following a beading pattern, can make the execution of a piece of beadwork faster and easier, and can ensure that a consistent and desirable tension is achieved. All the above results can be accomplished not only within the body of one piece of beadwork, but also with every piece of beadwork wherein this beading pattern surface and its accompanying method is used. The above results can also be achieved by both novice and advanced beaders, making the production of beadwork more efficient.

Although the description above contains a number of specifications, these should not be construed as limiting the scope of the invention but as merely providing illustrations of some of the presently preferred embodiments of this invention. For example, the spaces can have other sizes, such as for different sizes of beads; the spaces can have other layouts, such as for different beading stitches, etc.

Thus the scope of the invention should be determined by the appended claims and their legal equivalents, rather than by the examples given.

I claim:

1. A beading pattern surface for use in stitching a stitched beadwork comprising beads of specific designated nominal sizes which beading pattern surface comprises a pattern comprising spaces designating the location or placement of the beads to be used in constructing said stitched beadwork wherein:

(a) the size of said spaces in the parallel orientation in said beading pattern surface is more than 100% of the nominal size of said beads but not more than 125% of the nominal size of said beads; and (b) the size of said spaces in the perpendicular orientation is at least 100%, but not more than 110% of the nominal size of said beads; and (c) said beading pattern surface is not a structural element of the stitched beadwork at any time during said stitching.

2. The beading pattern surface of claim 1 in which the size of said spaces in the parallel orientation in said beading pattern surface is not less than 105%, but not more than 112% of the nominal size of said beads.

3. The beading pattern surface of claim 1 in which the size of said spaces in the parallel orientation in said beading pattern surface is not less than 108%.

4. The beading pattern surface of claim 1 in which the size of said spaces in the parallel orientation in said beading pattern surface is not less than 110%, but not more than 114% of the nominal size of said beads.

5. The beading pattern surface of claim 1, 2, 3 or 4 in which the size of said spaces in the perpendicular orientation is not less than 105% of the nominal size of said beads.

6. The beading pattern surface of claim 1, 2, 3 or 4 in which the size of said spaces in the perpendicular orientation is not more than 105% of the nominal size of said beads.

7. The beading pattern surface of claim 1, 2, 3 or 4 in which the size of said spaces in the perpendicular orientation is 100% of the nominal size of said beads.

8. A method of constructing a stitched beadwork comprising:

(a) selecting a form for constructing said stitched beadwork;

(b) placing or affixing the beading pattern surface of claim 1, 2, 3 or 4 directly over said form; and (c) stitching beads directly over said beading pattern surface.

9. A method of constructing a stitched beadwork comprising beading directly over the beading pattern surface of claim 1, 2, 3 or 4.

10. A device for constructing a stitched beadwork comprising:

(a) a form for constructing said stitched beadwork; and (b) the beading pattern surface of claim 1, 2, 3 or 4 placed or affixed to the exterior of said form.

11. The device of claim 10 wherein said form is tubular.

12. The method of claim 8 wherein said form is tubular.

13. The method of claim 8 wherein said form is flat.

14. The device of claim 10 wherein said form is flat.

* * * * *